US008960817B2

(12) United States Patent
Ceballos-Godefroy

(10) Patent No.: US 8,960,817 B2
(45) Date of Patent: Feb. 24, 2015

(54) FOLDING BASE FOR COUNTERS

(76) Inventor: Ricardo Ceballos-Godefroy, Mexico City (MX)

( * ) Notice: Subject to any disclaimer, the term of this patent is extended or adjusted under 35 U.S.C. 154(b) by 0 days.

(21) Appl. No.: 13/386,447

(22) PCT Filed: Jul. 22, 2010

(86) PCT No.: PCT/IB2010/001767

§ 371 (c)(1),
(2), (4) Date: Apr. 6, 2012

(87) PCT Pub. No.: WO2011/010212

PCT Pub. Date: Jan. 27, 2011

(65) Prior Publication Data

US 2012/0181905 A1 Jul. 19, 2012

(30) Foreign Application Priority Data

Jul. 24, 2009 (MX) ..... MX/A/2009/007899

(51) Int. Cl.

| | |
|---|---|
| ***A47B 43/00*** | (2006.01) |
| ***A47B 47/00*** | (2006.01) |
| ***A47B 96/18*** | (2006.01) |
| ***A47F 9/00*** | (2006.01) |
| ***A47B 3/00*** | (2006.01) |
| ***A47F 3/00*** | (2006.01) |

(52) U.S. Cl.

CPC .. *A47F 9/00* (2013.01); *A47F 3/004* (2013.01)
USPC ..... 312/262; 312/140.04; 312/258; 108/115

(58) Field of Classification Search

USPC ..... 312/258, 262, 140.1–140.4; 108/115
See application file for complete search history.

(56) References Cited

U.S. PATENT DOCUMENTS

| | | | | |
|---|---|---|---|---|
| 1,168,879 | A | 10/1875 | Colbert | |
| 1,528,156 | A * | 3/1925 | Lewis | 108/26 |
| 1,588,759 | A * | 6/1926 | Lewis | 108/25 |
| 3,271,914 | A * | 9/1966 | Boyett | 52/36.3 |
| 4,747,644 | A | 5/1988 | Gallery | |
| 6,412,424 | B1 * | 7/2002 | Dirks | 108/44 |

(Continued)

FOREIGN PATENT DOCUMENTS

| | | | |
|---|---|---|---|
| CH | 261318 | 5/1949 | |
| DE | 8513468 U1 * | 6/1985 | A47F 5/11 |

(Continued)

OTHER PUBLICATIONS

International Search Report PCT/IB2010/001767; Dated Dec. 29, 2010.

*Primary Examiner* — Janet M Wilkens
*Assistant Examiner* — Andrew Roersma
(74) *Attorney, Agent, or Firm* — Cantor Colburn LLP

(57) ABSTRACT

A folding base for counters having a left side panel, a left front panel hingedly connected to the left side panel, a right front panel hingedly connected to the left front panel, and a right side panel hingedly connected to the right front panel. The base further includes a left door hingedly connected to the left side panel, and a right door hingedly connected to the right side panel. The base has an upright position, in which the doors are opposite the front panels, while the side panels are opposite one another. The base also has a collapsed position, in which the side and front panels and the doors are arranged adjacent to one another. The base optionally includes a cover that can be separate from or hingedly mounted to one of the side panels.

2 Claims, 10 Drawing Sheets

(56) References Cited

U.S. PATENT DOCUMENTS

| | | | | |
|---|---|---|---|---|
| 6,851,564 | B2 * | 2/2005 | Ng | 211/149 |
| 2009/0032349 | A1 * | 2/2009 | Ceballos-Godefroy et al. | 190/103 |
| 2010/0127604 | A1 * | 5/2010 | Ceballos-Godefroy | 312/117 |
| 2010/0314979 | A1 * | 12/2010 | Ceballos-Godefroy | 312/244 |
| 2011/0042910 | A1 * | 2/2011 | Ceballos-Godefroy | 280/42 |

FOREIGN PATENT DOCUMENTS

| | | | | |
|---|---|---|---|---|
| GB | 1240109 | | 7/1971 | |
| MX | PA03000030 | A * | 6/2004 | A47B 3/00 |
| WO | 2006136874 | A1 | 12/2006 | |
| WO | WO2008047230 | A1 * | 4/2008 | A47F 5/10 |
| WO | 2008062286 | A2 | 5/2008 | |
| WO | WO2008072088 | A1 * | 6/2008 | A47F 3/06 |

* cited by examiner

FOLDING BASE FOR COUNTERS

FIELD OF THE INVENTION

The present invention relates to techniques employed in the manufacture and design of furniture, showcases and counters that offer products and services and, in particular, the invention relates to a folding base for counters, which includes a pair of doors, and preferably, adds a cover that is mounted on the base.

BACKGROUND OF THE INVENTION

In many places where public gather for the acquisition and exposure of products and services, such as fairs, conventions, information centers and so on, there is a need to use furniture and counters approach the public to the suppliers and present their products to them. In this regard, there is an important variety of such furniture, e.g. wooden-made, metallic, furnished with shelves, partitions; in general terms, though, they are bulky, difficult to handle and transport thereof results in hardships since they take up a lot of space.

One art-known solution to such problems has involved the creation of carton folding furniture and counters. Nevertheless, their structural rigidity is poor and, furthermore, it is impossible for one person to lean thereon. In addition, this type of carton-made furniture lacks of an outstanding aesthetical appearance, which is an important factor to achieve a commercial impact of the product or service being supplied.

There also exists furniture with countless panels, rods and posts that cooperate to each other; however, assembly thereof is time-consuming and the pieces to be assembled are too many.

Despite the above, there are counters that have been broadly accepted and which are practical to use for such purposes, among them those counters that contain a base and a cover mounted on the base and a board assembled on at least one post that is inserted in the cover. In this type of counters, the board helps to identify the name of the supplier or the product being offered while the supplier is located behind the counter to attend to the customers approaching the module.

One of such counters is disclosed in Mexican patent No. 212,227, whose most significant advantage is that the counter elements can be disassembled and stored in the form of a briefcase, in which the cover forms a shield of said briefcase and the base is housed within; at the same time the other pieces of the counter are also housed therein.

The counter of the above-mentioned patent was restructured in Mexican patent No. 225,710, wherein the most significant changes are the inclusion of 45° cuttings between the post sections that support the board and a second shelf that runs on a rail, in addition a support to secure the post sections within the second shelf was included. In spite of such modification, the board is still unstable since it sways over the cover. Furthermore, the shelves frequently fall off their horizontal position because at their free side ends the shelves are secured only by pressure between the side panels of the base.

In international patent application No. PCT/1B2005/002083, there are provided a series of modifications to the counter of Mexican patent No. 225,710, and such modifications relate to the inclusion of media to support shelves firmly so that they do not move, either that the counter is in a upright position or folded.

In this type of counters, the cover is an independent piece that must be manipulated to mount it on the base, and serves as a house for the folded base, which may become complicated for some people, apart from the fact that it takes time to do these operations.

As it may be observed, the base of the counters of the previous art has a substantial role, since it is the part that supports all the weight, and products to offer are placed on it. Another function of the base is that it functions as a housing for storing the other pieces of the counter, and furthermore, it is preferably foldable so that it takes little space when the counter is disassembled.

In addition, bases for the counters of the prior art are fully open on the back, being desirable to have a closed base to keep the products shown in these counters. However, it should not lose the characteristics of being a foldable, light-weight base.

SUMMARY OF THE INVENTION

Pursuant to the above, the purpose herein has been to overcome the drawbacks of the bases for counters on which a cover is mounted, and above the last a board, developing a base provided with doors, in which the base is foldable and takes minimal space when folded. The base is structurally resistant to place on it the products that will be exhibited on the counter.

The base for counters of the present invention comprises a left side panel, a left front panel hingedly connected to the left front panel; a right front panel hingedly connected to the left front panel; and a right side panel hingedly connected to the right front panel. Moreover, the base of the present invention further comprises a left door hingedly connected to the left side panel; and a right door hingedly connected to the right side panel.

The base has an "upright" position, in which the doors are opposed to the front panels, while side panels are opposed to each other. In addition, the base has a "folded" position in which side panels, front panels and doors are adjacent one next to the other in an accordion way.

In a preferred embodiment of the invention, in the "folded" position of the base, the left door and the right door are housed in the left front panel and the right front panel, respectively, with which the volume of the folded base is reduced considerably.

In an additional embodiment of the present invention, the base further comprises a cover that is mounted on the base. The cover may be an independent piece or it may be hingedly connected to one of the side panels, in such a way that it may be taken from a horizontal position when the base is in its upright position to a vertical position when the base is its folded position.

In a specific embodiment of the invention, in the folded position of the base, the cover is laterally placed next to one of the side panels of the base.

In an additional embodiment of the invention, the base also comprises a pair of wheels mounted on at least one of the side panels, with which the base can easily move, either in the upright position or in the folded position, which is extremely useful when products are shown on the counter.

In one aspect of the invention, a counter is provided, comprising the base as it has been defined previously, a cover mounted on the base; at least one post inserted in the cover; and a board that is coupled to the post. Preferably, the post is inserted into the cover and it is received in one of the side panels of the base.

BRIEF DESCRIPTION OF THE DRAWINGS

Novel aspects featured by the present invention shall be set forth in connection with the appended claims. Nevertheless, the invention itself shall be better understood regarding its structure, as well as other objects and advantages of the same, with the following detailed description of a preferred embodiment thereof, when read in conjunction with the appended figures, in which:

DETAILED DESCRIPTION OF A PREFERRED EMBODIMENT OF THE INVENTION

Figure 1:
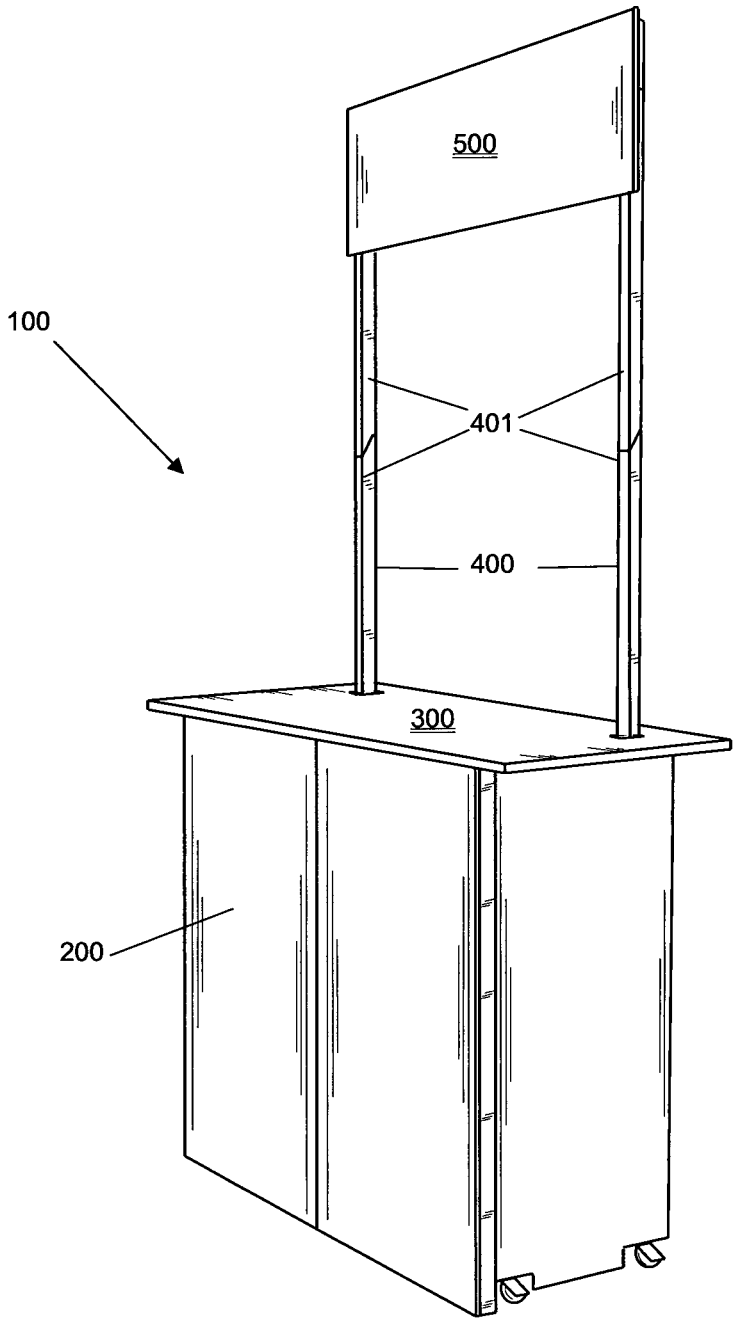
FIG. 1 is a front and upper perspective view of a counter with a base built in accordance to a preferred embodiment of the present invention.

With reference to the accompanying drawings and more specifically, to FIG. 1 thereof, it is shown a counter 100 comprising a base 200; a cover 300 which is mounted on the base 200; a pair of posts 400 that are inserted in the cover 300 and are supporting a board 500 vertically separated from the base 200. The posts 400 are formed by a pair of sections 401, upper and lower, which couple with each other. The board 500 may also be supported by a single post and even, each post 400 may be done in a single piece. The counter 100 of FIG. 1 is a typical example where the base of the present invention may be used, which is described as follows in its preferred embodiment.

Figure 2:
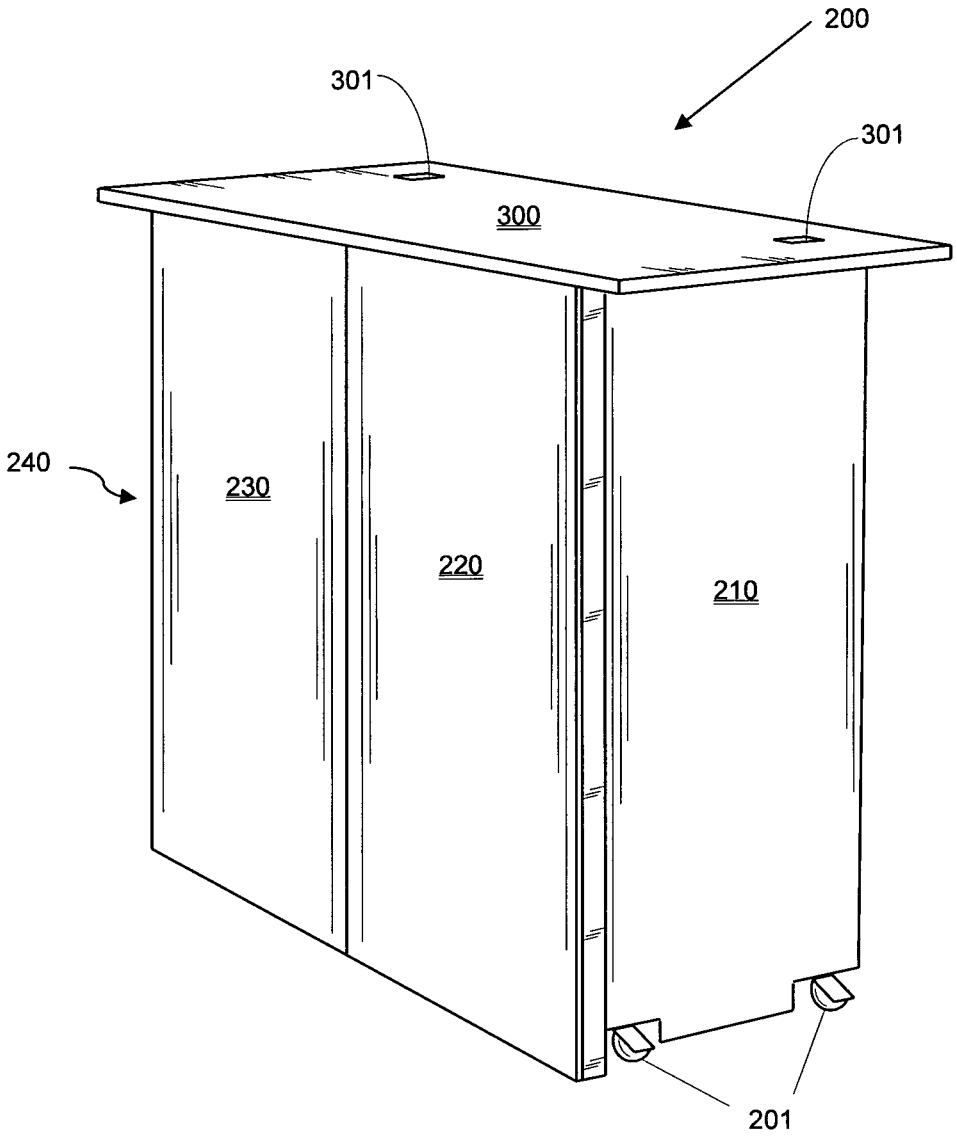
FIG. 2 is an upper perspective view of a base for counters built in accordance with the preferred embodiment of the present invention.

So, reference is made to FIG. 2 which shows the base 200 in its "upright" position, which includes a left side panel 210; a left front panel 220 hingedly connected to the left side panel 210; a right front panel 230 hingedly connected to the left front panel 220; and a right side panel 240 hingedly connected to the right front panel 230. Over the base 200, there is a cover 300 placed, which is provided with a couple of holes 301, where the posts supporting the board are inserted, and which were illustrated in FIG. 1. In the present invention, it is possible that the cover 300 only has one hole 301 for those boards supported only by one post. Likewise, posts may cross the cover and get inserted in the side panels to make a stronger mount.

In the lower part of the base 200, there is a pair of wheels 201 mounted at the lower part of the left side panel 210, in a similar way, in the lower part of the right side panel 240, there is another pair of wheels that, in FIG. 2, cannot be seen. The wheels 201 make it easier to move all the base 200 from one side to another, mainly when, within it, there are products, and particularly in its upright position.

Figure 3:
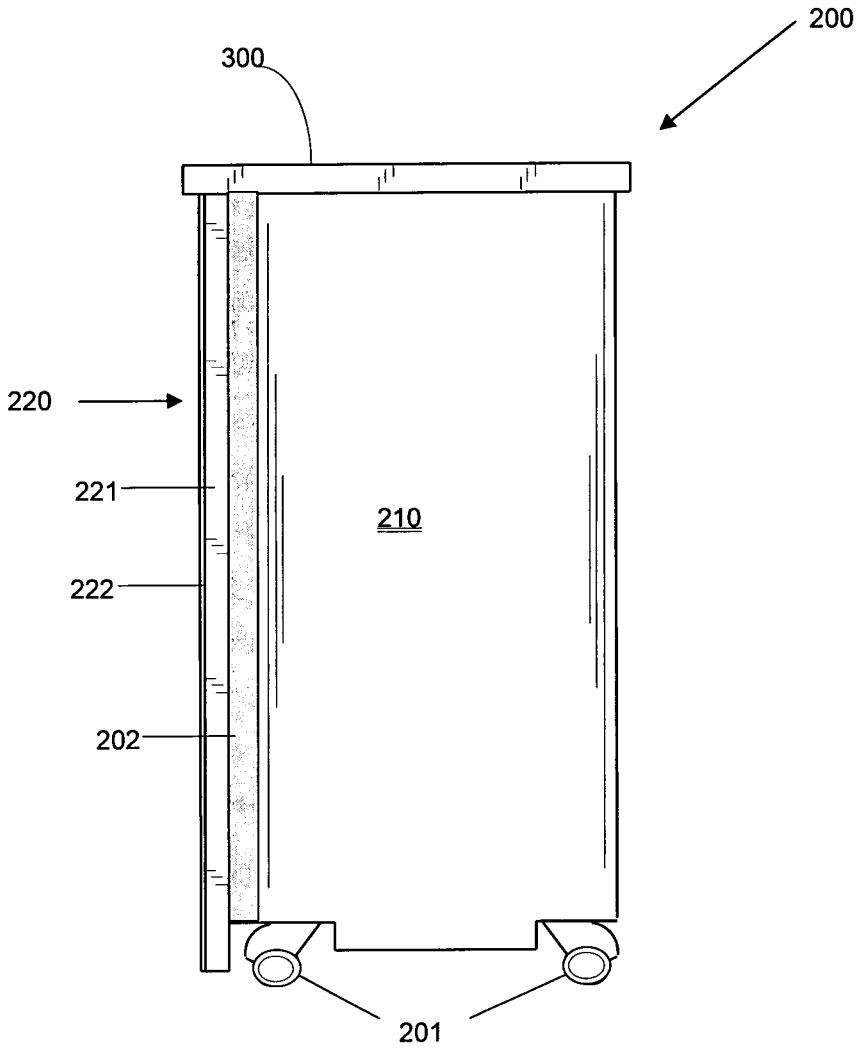
FIG. 3 is a left side view of the base shown in FIG. 2.

FIG. 3 shows a left side view of the base 200 according to the embodiment that is currently disclosed, where it can be observed, the left side panel 210 hingedly connected to the left front panel 220 by means of a plastic hinge 202 running up downward.

The left front panel 220 is formed by a frame 221 of rectangular shape on which there is a plate 222 joined. In this sense, it is worth mentioning that the right front panel 230, as well as the side panels, left and right, 210 and 240 are formed in a similar manner, that is to say, each of them comprises a frame on which there is a plate assembled. The hinged connection of side and frontal panels 210, 220, 230 and 240 of the base is done by means of plastic hinges such as the plastic hinge 202. However, other type of hinges such as metal, piano-type hinges may be used to achieve the structural connection required for the base of the present invention. Finally, in FIG. 3, it is also observed the wheels 201 and the cover 300 which is mounted on the base 200.

Figure 4:
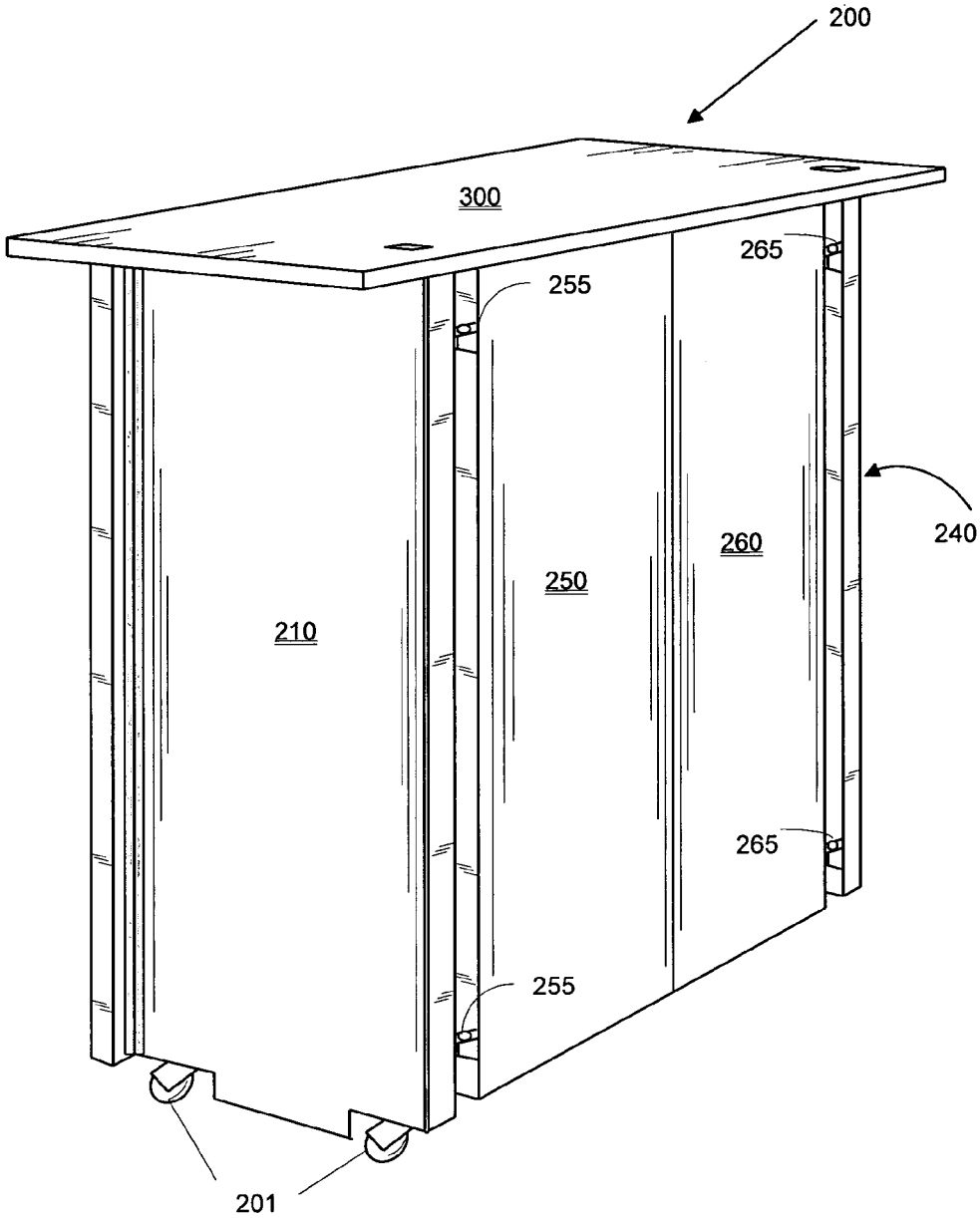
FIG. 4 is a rear and upper perspective view of the base for counters of FIG. 2.
Figure 5:
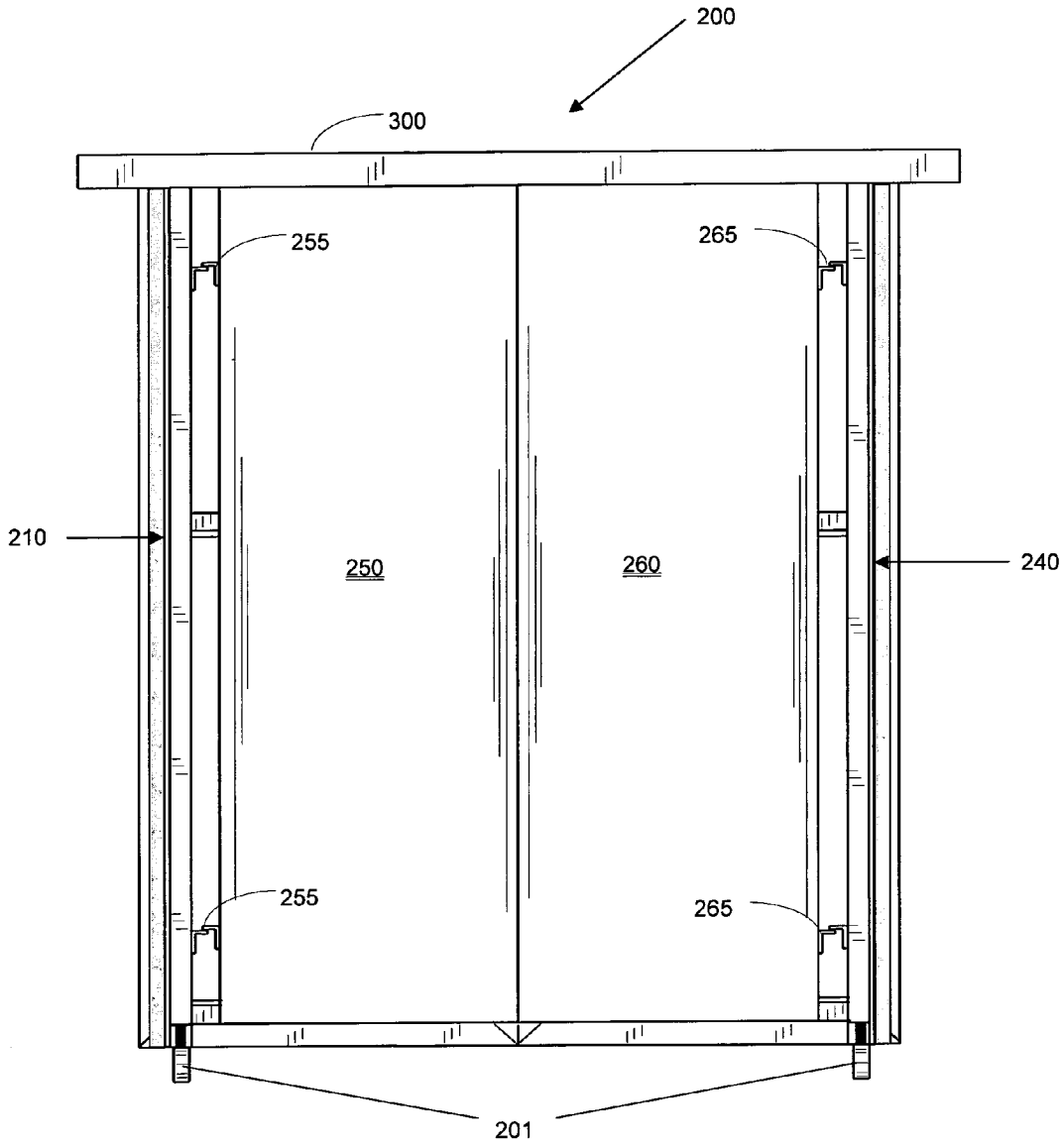
FIG. 5 is a rear view of the base illustrated in FIG. 2 with its doors closed.

Now, reference is made to FIGS. 4 and 5 to show some characteristic elements of the base 200 of the embodiment described in here, and as observed, the base comprises a left door 250 hingedly connected to the left side panel 210 by means of a pair of metal hinges 255; and a right door 260 hingedly connected to the right side panel 240, by a pair of metal hinges 265 separated vertically from one another. These FIGS. 4 and 5 show that the base 200 rests on the wheels 201, with which it may be moved easily from one place to another in an upright position, where the side panels 210 and 240 are opposite to each other, and the front panels 220 and 230 are opposite to the doors 250 and 260, and these latter ones allow to have access and control on the products that are placed inside the base 200 and on which there is the cover 300. The doors 250 and 260 may be locked with each other through locking means like locks, keyholes, pins, etc., to restrict access to the inside part of the base.

Figure 6:
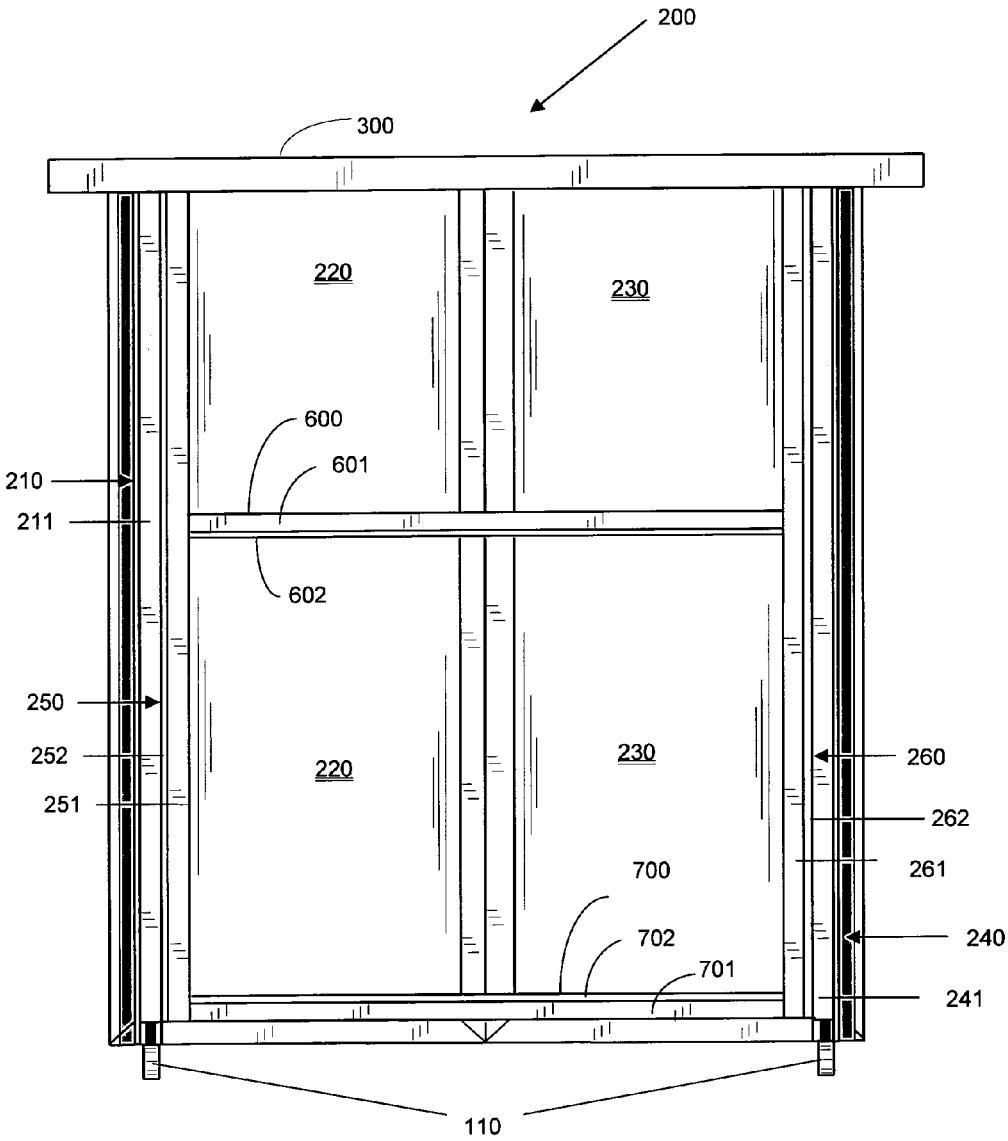
FIG. 6 is a rear view of the base shown in FIG. 5 with its doors open.

Going to FIG. 6, it shows the base 200 with its doors 250 and 260 open, each door is formed respectively by a frame 251 or 261 which preferably has a rectangular shape, on which a plate 252 or 262 is joined. In a preferred embodiment, the doors 250 and 260 have a size smaller than the frontal panels 220 and 230 in order to be housed inside them, and so reduce the size of the base 200 once it is folded. The doors 250 and 260 have a wide movement, more than 270°, to be able to move both inside and outside of the base, and to place them to one side of the side panels 210 and 240 when the base 200 gets folded.

Inside the base 200, there is an upper shelf 600 and a lower shelf 700 mounted between the side panels 210 and 240, of them, the upper shelf 600 is formed by a frame 601 which has a plate 602 attached, said frame 601 is oriented upward. The upper shelf 600 is mounted in a sliding and rotating manner to the frame 211 of the left side panel 210, this means that the upper shelf 600 may move upward on its left side, and when it is at its uppermost position, it rotates on the left side in a descending direction to be housed within the left side panel 210, as shown in the teachings of international application No. PCT/IB2005/002083 incorporated herein by reference.

On the other hand, the lower shelf 700 is formed by a frame 701 and a plate 702 joined on such frame, the shelf 700 is hingedly connected to the lower side of the frame 241 of the right side panel 240 in such a way that, when lifting it, the lower shelf 700 is housed in the right side panel 240, as shown in the teachings of the afore mentioned international application No. PCT/1B2005/002083. The connection of the lower shelf with the frame 241 is done with a piano-type hinge.

Now, in a preferred embodiment, the shelves 600 and 700 are elements separated of base 200 and they may be mounted on supports provided in the frames 211 and 241 of the left and right side panels 210 and 240. At this point, it is convenient to mention that the shelves 600 and 700 are optional elements of the base of the present invention, but they are illustrated in the mode described to give evidence on the advantages and flexibility of the present invention. Furthermore, structural configuration of these shelves may be such that the upper shelf 600 is connected in a sliding fashion to one of the side panels 210 or 240, while the lower shelf is connected as a hinge also to one of the side panels 210 or 240. This is, the shelves 600 and 700 may be connected to one of the two side panels 210 or 240.

Another important characteristic of the embodiment of the base described in here, is related to the cover 300, which is hingedly connected to one of the side panels by hinge means, in such a way that it may be taken from a horizontal position to a vertical position in order to fold it. This solves one of the problems of the previous designs, where the cover is an independent element, and when trying to assemble or disassemble it from the base, it requires effort and it is time-consuming.

Figure 7:
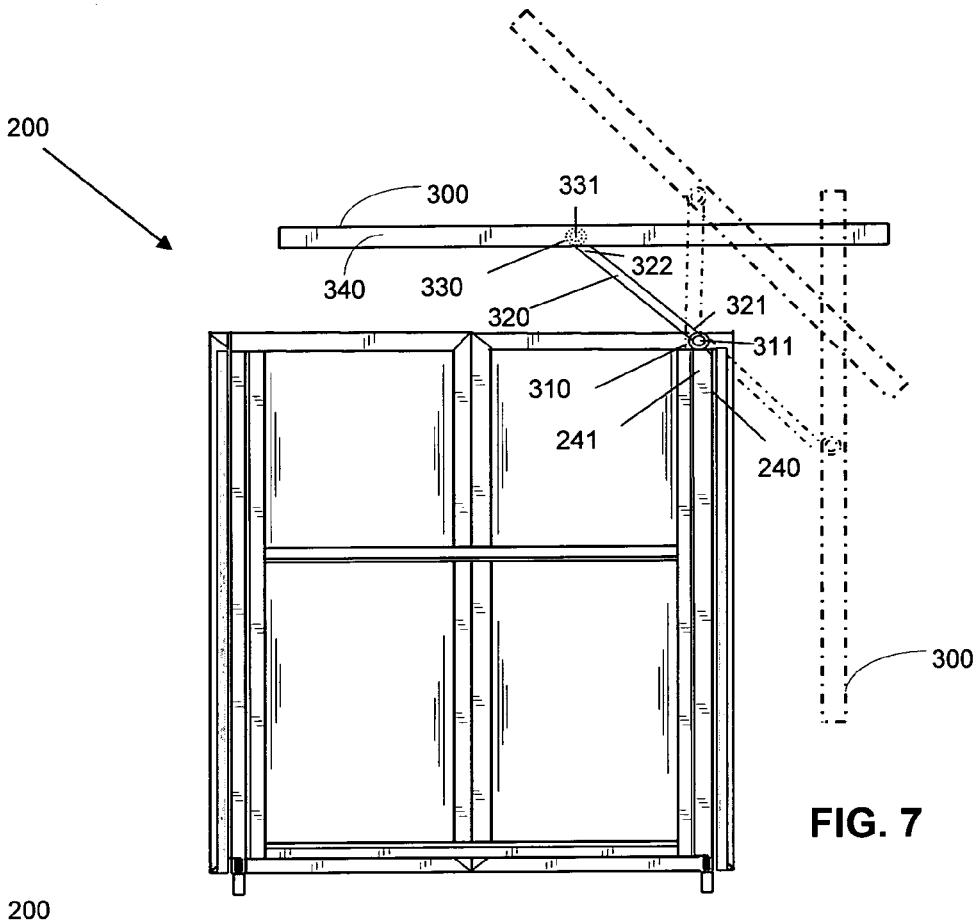
FIG. 7 is a rear view of the base illustrated in FIG. 6, in which the movement sequence to fold the cover is showed.
Figure 8:
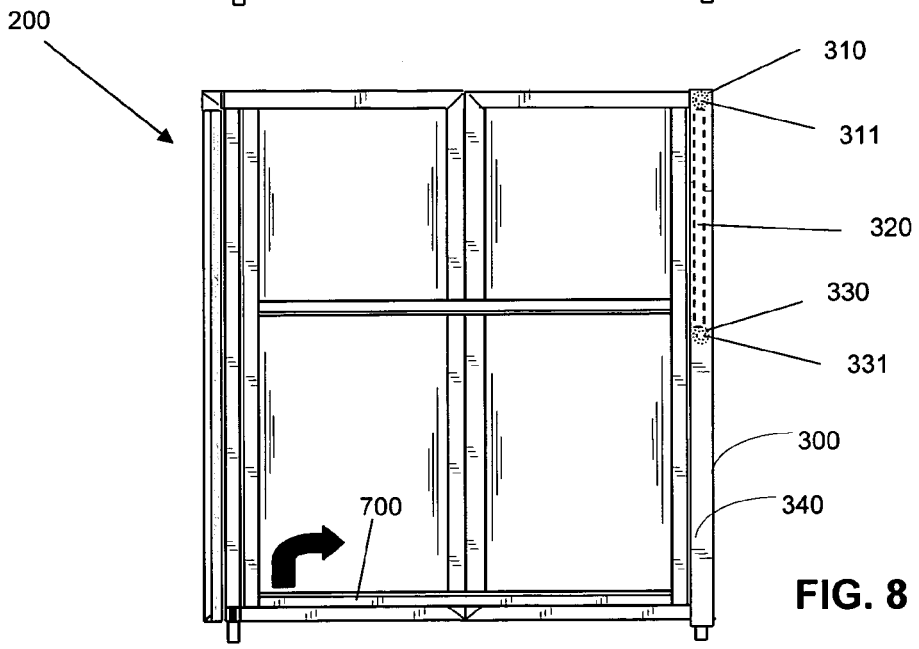
FIG. 8 is a rear view of the base illustrated in FIG. 6, in which the cover is already folded.

In order to explain this characteristic, reference is made to FIGS. 7 and 8, where it may be observed that in the embodiment describe in here, hinge means include a lower rotary base 310 mounted over the right side panel 240, particularly over the frame 241, the lower rotary base 310 includes a rotation axis 311; another piece of this connection is an arm 320 which has a lower end 321 and an upper end 322, of which the lower end 321 is crossed by the rotation axis 311 of the lower base 310, while the upper end 322 is crossed by the rotation axis 331 of an upper rotary base 330 which is mounted and hidden under the cover 300.

The cover 300 has a rectangular shape with a perimeter wall 340 with a height enough in order to hide the arm 320, as well as the rotary bases 310 and 330 when the base 200 is either standing-up or folded. Other hinge means may be used for this connection of the cover with one of the side panels, among said hinge means may be a moving frame as a replacement of arm, or an arm-shock absorber, etc.; what is important is that the arm 320 allows to connect the cover 300 to one of the side panels 210 or 240 and take it from a substantially horizontal position up to a substantially vertical position, in order to make easier the assembly or disassembly of the cover 300 on base 200.

On the other hand, FIG. 8 illustrates the ascending rotation movement that follows the lower shelf 700 in order to be housed inside the left side panel that is hidden by the cover 300.

Figure 9:
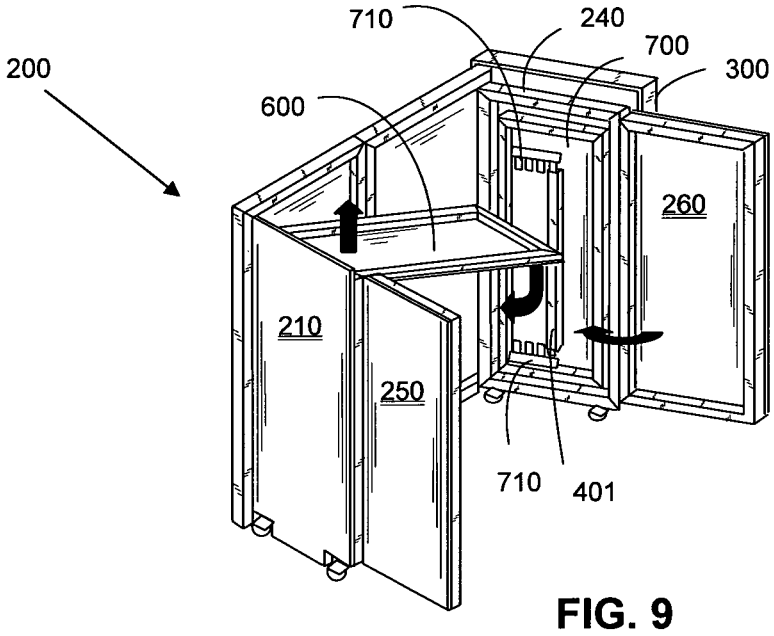
FIG. 9 is an upper perspective view of the base illustrated in FIG. 8 which shows the movement to fold the upper shelf and the right door.
Figure 10:
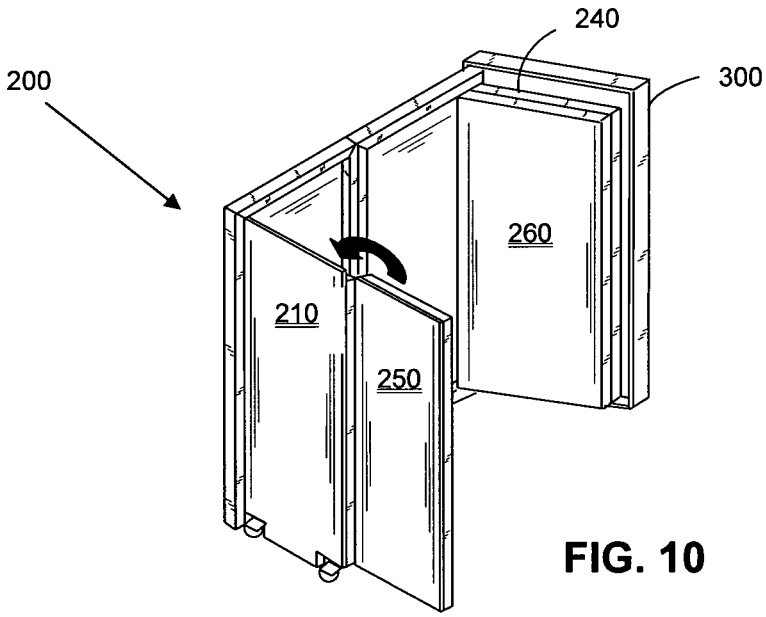
FIG. 10 is an upper perspective view of the base illustrated in FIG. 9 which shows the movement to fold the left door.

With the aid of FIGS. 9 to 14, a description will be given of the way in which base 200 is taken up to its folded position. In FIG. 9, the base has its doors 250 and 260 open, while the lower shelf 700 is already housed in the right side panel 240. On the one hand, the upper shelf 600 is lifted over its left side and then it rotates downward to be housed in the left side panel 210. In this FIG. 9, it may be seen that the lower shelf 700 includes a pair of supports 710 to assemble with them the connectable sections 401 with which posts supporting the board of the counter are assembled, which is illustrated in FIG. 1. In turn, on the upper shelf 600, already assembled, it is possible to assemble on it the counter board, also illustrated in FIG. 1 to hold it also to the left side panel 210. These characteristics are illustrated in the international application No. PCT/1B2005/002083.

Back to FIG. 9, on one side of the right side panel 240 there is the cover 300 in vertical position. The right door 260 is turned 180° to place it next to the right side panel 240 covering the lower shelf 700 until reaching the position shown in FIG. 10. In this figures, it is possible to see that, in order to continuing folding the base 200, the left door 250 is turned toward the inside of base 200 to assemble it next to the left side panel 210 and so, reach the position shown in FIG. 11.

Figure 11:
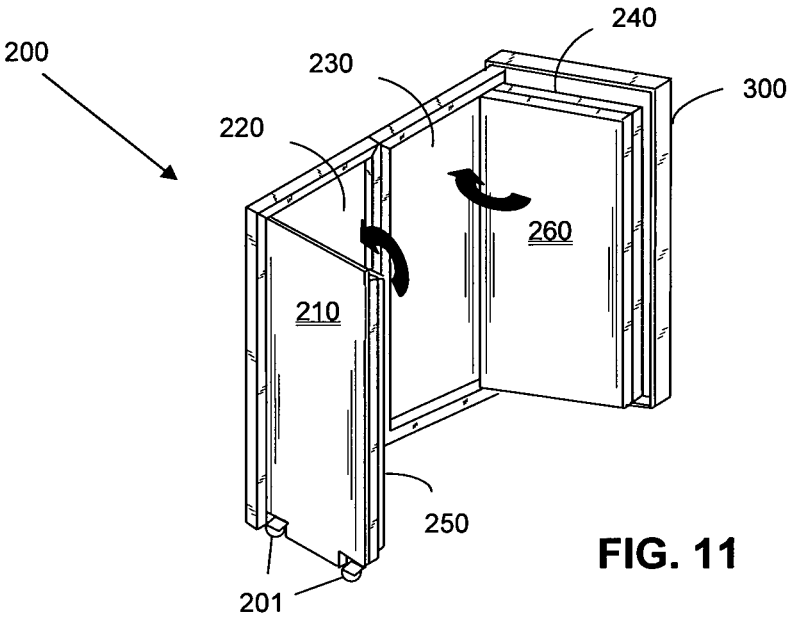
FIG. 11 is an upper perspective view of the base illustrated in FIG. 10 which shows the movement to fold the side panels.
Figure 12:
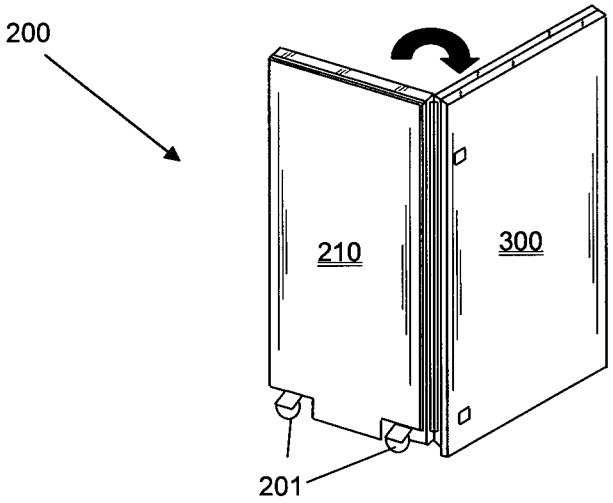
FIG. 12 is a front and upper perspective view of the base illustrated in FIG. 11 which shows the final movement to fold the base.
Figure 13:
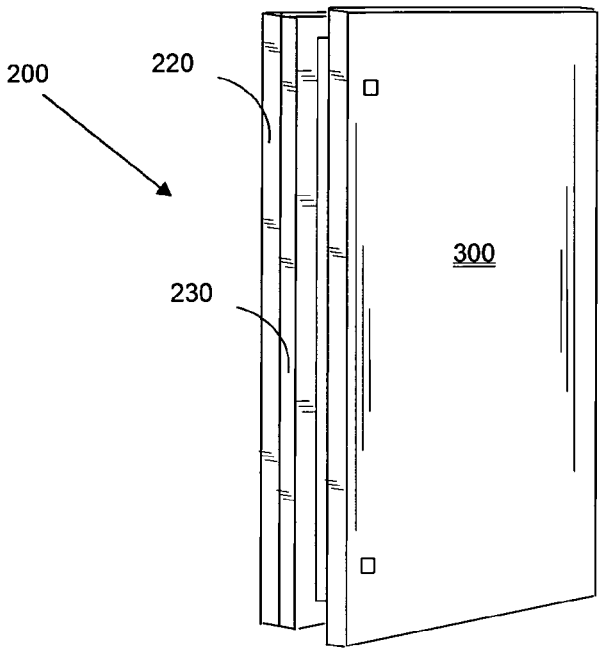
FIG. 13 is a perspective view of the base illustrated in FIG. 12 completely folded.
Figure 14:
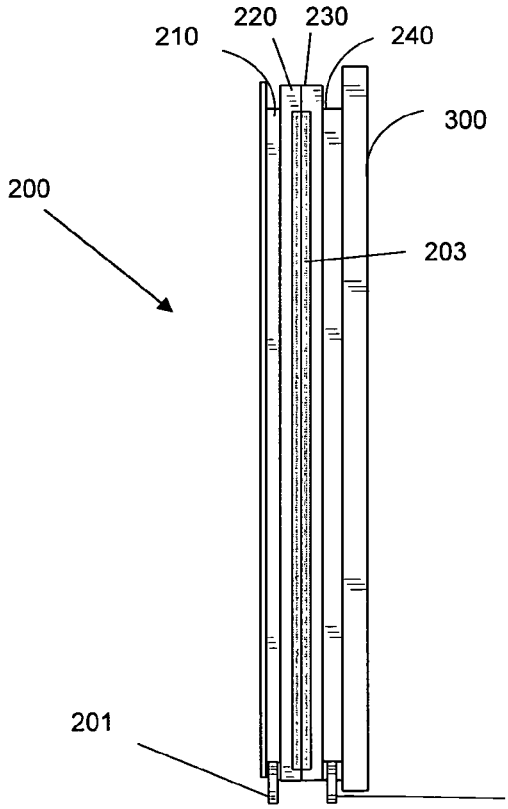
FIG. 14 is a side perspective view of the base illustrated in FIG. 13.

Then, and just as shown in FIG. 11, both, the left side panel 210 and the right side panel 240 are turned inward so that the left 250 and the right 260 doors are housed in the front panels 220 and 230, this movement becomes easier thanks to the wheels 201, in such a way that, at the end of this movement, there are two halves that turn to one another, supporting again on wheels 201 as illustrated in FIG. 12 so that finally, they reach the base in the folded position, as illustrated in FIGS. 13 and 14.

FIGS. 13 and 14 show the folded position of the base 200, which is extremely compact, where it is possible to see that next to the left side panel 210 there is the left front panel 220 in which there is the left door housed. Likewise, next to the left front panel 220 there is the right front panel 230 in which there is the right door housed. FIG. 14 shows the plastic hinge 203 by which connection is made among the front panels 220 and 230. Finally, next to the right front panel 230 there is the right side panel 240 and next to it, there is the cover 300. The base 200 in its folded position is supported by the wheels 201, with which the base in this position may move from one place to another very easily.

It is preferred that materials with which the most important elements of the base are manufacture, this is, the side panels, the front ones, doors, shelves and cover are light-weight materials such as polymers, preferably polyvinyl chloride (PVC), although they may be manufactured with other materials, such as wood, cardboard, etc.

Even when a preferred embodiment of the invention has been described and exemplified, it should be stressed that several modifications of it are possible, such as the choice of placing shelves inside the base or mount one, two or more posts to support a board. Therefore, this invention should not be considered as limited except for what it is required by the prior art and by the scope of the appended claims.

REFERENCE LIST

100 Counter
200 Base
  201 Wheels
  202 Plastic hinge
  203 Plastic hinge
210 Left Side Panel
  211 Frame of the left side panel
220 Left Front Panel
  221 Frame of the left front panel
  222 Plate of the left front panel
230 Right Front Panel
240 Right Side Panel
  241 Frame of the right side panel
250 Left Door
  251 Frame of the left door
  252 Plate of the left door
  255 Metal hinges
260 Right Door
  261 Frame of the right door
  262 Plate of the left door
  265 Metal hinges
300 Cover

301 Holes
310 Lower rotary base
311 Rotation axis of the lower base
320 Arm
321 Lower end
322 Upper end
330 Upper rotary base
331 Rotation axis of the upper base
340 Perimeter wall
400 Posts
401 Sections of the posts that may be connected
500 Board
600 Upper shelf
601 Frame of the upper shelf
602 Plate of the upper shelf
700 Lower shelf
701 Frame of the lower shelf
702 Plate of the lower shelf
710 Supports for the post sections

What is claimed is:

1. A counter comprising:

a foldable base including:

a left side panel;

a left front panel hingedly connected to the left side panel;

a right front panel hingedly connected to the left front panel;

a right side panel hingedly connected to the right front panel; wherein each of the side panels and each of the front panels comprises a frame and a plate attached thereto;

a left door hingedly connected to the left side panel;

a right door hingedly connected to the right side panel; wherein the left and right doors each have a size smaller than the front panels to be received therein;

a cover that is mounted on the base and is hingedly connected to the right side panel; the cover having a rectangular shape and including a perimeter wall; wherein the cover also includes a pair of holes;

hinge means for connecting the cover to the right side panel, so that the cover is moved from a horizontal position when the base is in a stand up position to a vertical position when the base is in a folded position; the hinge means comprising a lower rotary base mounted over the frame of the right side panel, the lower rotary base including a rotation axis;

an arm which has a lower end and an upper end; and, an upper rotary base which includes a rotation axis, the upper rotary base being mounted and hidden under the cover;

wherein the lower end of the arm is crossed by the rotation axis of the lower base, while the upper end of the arm is crossed by the rotation axis of the upper base;

wherein the perimeter wall of the cover has a height enough in order to hide the arm, as well as each of the rotary bases when the foldable base is in its folded position or in the stand up position;

a pair of posts supporting a board, each post being inserted through one hole of the cover; each post being received in one of the side panels in the stand up position of the base;

an upper shelf that is slidingly connected to the left front panel;

a lower shelf that is hingedly connected to the right front panel;

wherein the upper shelf and the lower shelf are mounted between the side panels;

wherein in the stand up position of the base, the doors are opposed to the front panels, while the side panels are opposed to each other; and in the folded position of the base, the upper shelf is housed in the left side panel; the lower shelf is housed in the right side panel, while the left door is placed to one side of the left side panel and is housed in the left front panel and the right door is placed to one side of the right side panel and is housed in the right front panel, such that when the base is folded, the left front panel is disposed next to the left side panel, the right front panel is disposed next to the left front panel, the right side panel is disposed next to the right front panel, and the cover is disposed next to the right side panel; and a pair of wheels mounted at a lower part of each of the side panels.

2. A counter according to claim 1, wherein the post includes a lower section and an upper section that couple with each other.

* * * * *